US011512522B2

(12) United States Patent
Martin

(10) Patent No.: US 11,512,522 B2
(45) Date of Patent: Nov. 29, 2022

(54) INTERIOR PRE-HUNG HINGED DOOR AND POCKET SLIDING SECURITY GATE

(71) Applicant: Rodney Hale Martin, Ponce de Leon, FL (US)

(72) Inventor: Rodney Hale Martin, Ponce de Leon, FL (US)

( * ) Notice: Subject to any disclaimer, the term of this patent is extended or adjusted under 35 U.S.C. 154(b) by 13 days.

(21) Appl. No.: 17/200,803

(22) Filed: Mar. 13, 2021

(65) Prior Publication Data

US 2022/0290487 A1 Sep. 15, 2022

(51) Int. Cl.

| | |
|---|---|
| ***E06B 3/46*** | (2006.01) |
| ***E06B 9/04*** | (2006.01) |
| ***G08B 13/08*** | (2006.01) |
| ***E06B 9/00*** | (2006.01) |
| ***E05D 15/06*** | (2006.01) |
| *G08B 13/00* | (2006.01) |

(52) U.S. Cl.

CPC ..... *E06B 3/4654* (2013.01); *E05D 15/0678* (2013.01); *E05D 15/0682* (2013.01); *E06B 9/00* (2013.01); *E06B 9/04* (2013.01); *G08B 13/08* (2013.01); *E06B 2009/002* (2013.01); *G08B 13/00* (2013.01)

(58) Field of Classification Search

CPC ..... E06B 3/4654; E05D 15/0678; E05D 15/0682

USPC ..... 49/323

See application file for complete search history.

(56) References Cited

U.S. PATENT DOCUMENTS

| | | | | |
|---|---|---|---|---|
| 2,190,149 | A * | 2/1940 | Coleman | E06B 3/4636 16/92 |
| 3,400,490 | A * | 9/1968 | Anderson | E05D 15/06 49/504 |
| 3,993,988 | A * | 11/1976 | Walter | G08B 13/08 340/548 |
| 4,151,382 | A * | 4/1979 | Kaufman | G08B 13/08 200/61.81 |
| 5,873,205 | A * | 2/1999 | Hanlon | E04B 2/7416 49/404 |
| 8,196,353 | B2 * | 6/2012 | Loidolt | E05D 15/0669 49/404 |
| 8,555,573 | B2 * | 10/2013 | Ellison | E06B 3/02 52/207 |
| 10,174,543 | B2 * | 1/2019 | Kapavik | E06B 9/04 |

(Continued)

FOREIGN PATENT DOCUMENTS

GB 2450984 A * 1/2009 ..... E05B 15/0205

*Primary Examiner* — Marcus Menezes

(57) ABSTRACT

The invention relates to a sliding security gate inside a pocket attached to an interior pre-hung hinged door. These pocket sliding security gates can be assembled inside any doorway opening of one's home for the protection of babies, toddlers, pets, and disabled elderly. On one hand, the Pre-Hung Hinged Door and Pocket Sliding Security Gate can be used as a dual functioned component that can be used in a normal setting to provide privacy; on the other hand, the Pre-Hung Hinged Door and Pocket Sliding Security Gate can be used as a half door that is assembled as a pocket sliding security gate to provide safety and security to the vulnerable population listed above. In addition, this pocket sliding security gate also has an alarm attached to the security gate so that when it opens, the alarm sounds to let the gatekeeper know that the security has been breached.

1 Claim, 11 Drawing Sheets

(56) References Cited

U.S. PATENT DOCUMENTS

| | | | | |
|---|---|---|---|---|
| 2004/0003556 | A1* | 1/2004 | Zerbst | E04B 2/7422 52/239 |
| 2004/0148865 | A1* | 8/2004 | Duncan | E05C 3/16 49/415 |
| 2006/0230684 | A1* | 10/2006 | Poole | E05D 15/0634 49/409 |
| 2013/0081332 | A1* | 4/2013 | Baumert | E06B 1/58 49/397 |
| 2018/0209192 | A1* | 7/2018 | Selvaag | E05D 15/06 |

* cited by examiner 105
108

105

110
109
108
105

105
108
110
110

INTERIOR PRE-HUNG HINGED DOOR AND POCKET SLIDING SECURITY GATE

STATEMENT REGARDING FEDERALLY SPONSORED RESEARCH

Not Applicable

REFERENCE TO SEQUENCE LISTING

Not Applicable

FIELD OF INVENTION

The invention relates to a sliding security gate inside a pocket attached to an interior pre-hung hinged door.

BACKGROUND OF THE INVENTION

A security gate is designed to be a protective device specifically for babies and toddlers, as well as pets to keep them safe and secure in certain particular rooms of one's home. However, in addition, security gates are especially crucial and important for the disabled elderly. For example, the security gate is beneficial for someone who is diagnosed with dementia and has a tendency to leave the home or get into an area inside the home that can be dangerous for their well being. Some of the areas of the home that are beneficial for security gates include staircases both top and bottom, kitchen, bathroom, basement, balcony, and doors to the outside. Not only are security gates protective devices for babies, toddlers, pets, and the disabled elderly, security gates provide a sense of peace of mind for the family members and those carrying for them.

Usually security gates are made of metal, plastic, or wood and are designed to be either hardware-mounted or pressure-mounted gates. Hardware-mounted gates are mounted to the wall; whereby pressure-mounted gates are adjusted to the size of the door and are locked into place. These gates are movable to different locations and are a temporary solution to safety and security.

BRIEF SUMMARY OF THE INVENTION

The present invention relates to an interior pre-hung hinged door and frame unit with an attached pocket which houses a sliding gate that opens and closes across the door opening. This is a dual-function product whereby it allows the functionality of an operating swinging door to be used for privacy, as well as the added element of a sliding gate to secure the opening, still allowing for visual contact. In addition, this sliding gate locks securely on the opposite side of the door. For added security, this sliding gate has an attached alarm to it whereby when the gate becomes opened, the alarm goes off and alerts those who are nearby to check on their loved ones. This invention is for new construction or remodeling applications.

In comparison to previous gates, the Interior Pre-Hung Hinged Door and Pocket Sliding Security Gate has the following advantages:

a. The sliding gate provides a convenient, quick, and easy operation method, which can change from the use of a full-size door to the use of a half-size door through a simple operation. The sliding gate provides the integral structure change without drastic changes to the door so that the storage of the sliding gate is more convenient and accessible.

b. The sliding gate has the advantages of being a simple and compact gate, easily operated, and stowes away in the pocket.

c. There is no setting up and no preparation—the sliding gate is already installed in the unit.

d. The sliding gate is made of durable material; i.e., metal, plastic, wood, or composite, whereby it is strong and does not break. It does not have to be replaced due to wear and tear of poor manufactured products that are not safe and not secure.

e. The interior pre-hung hinged door and the pocket sliding security gate can be closed and it can still operate. The door is used for privacy; the sliding gate is used for security when the door is open.

f. An additional feature of this pocket sliding gate is the attached alarm component that when the gate becomes opened the alarm goes off to indicate that the security of the gate has been breached.

g. Lastly, the sliding gate is firmly and securely locked/latched to the opposite door frame so that it cannot be knocked over whereby injuries can be sustained. Although this pocket sliding gate is strong and durable and latches onto the door frame, the alarm feature is another safety and security component of this invention. It provides the gatekeeper peace of mind knowing that there is a dual security protection for the safety of their loved ones.

h. This product would generally be installed in new construction and/or remodeling application, and could be done as a single project to an already existing structure.

This sliding gate solves previously existing problems whereby the door and sliding gate are one unit. Therefore, you only need to purchase just one product, not two. In addition, as stated above, this sliding gate has the durability of being strong, secure, and safe for babies and toddlers, pets, and the disabled elderly. It is a permanent fixture within the door frame so that it does not have the tendency to break easily and is accessible to anyone who uses it. It is simple and easy to use and does not require a great deal of time in putting a sliding gate across a particular room for the safety and security of the ones' it is intended to protect.

COMPONENT LIST

100—Interior Pre-Hung Hinged Door and Pocket Sliding Security Gate
101—Wood Pocket Frame
102—Pre-Hung Hinge Door Frame
103—Hinged Door
104—Pass-Through Opening
105—Sliding Security Gate
106—1"×3" Wood Pocket Framing
107—Pressure-Treated 1"×3" Wood Bottom Plate
108—Ball-Bearing Drawer Sliding Mechanism
109—Shim-Pack System
110—Dolly-Style Wheel
111—Openings Between the Vertical Slats of the Security Gate
111*a*—Vertical Slats of the Security Gate
112—Screw Fasteners
113—Hinges
114—Battery-Operated Alarm
115—Right-Angle Latch
116—Door Stop Extension
117—Plastic or Nylon Glides

DETAILED DESCRIPTION OF THE INVENTION

Detailed illustrated embodiments of the present invention are disclosed herein.

Figure 1:
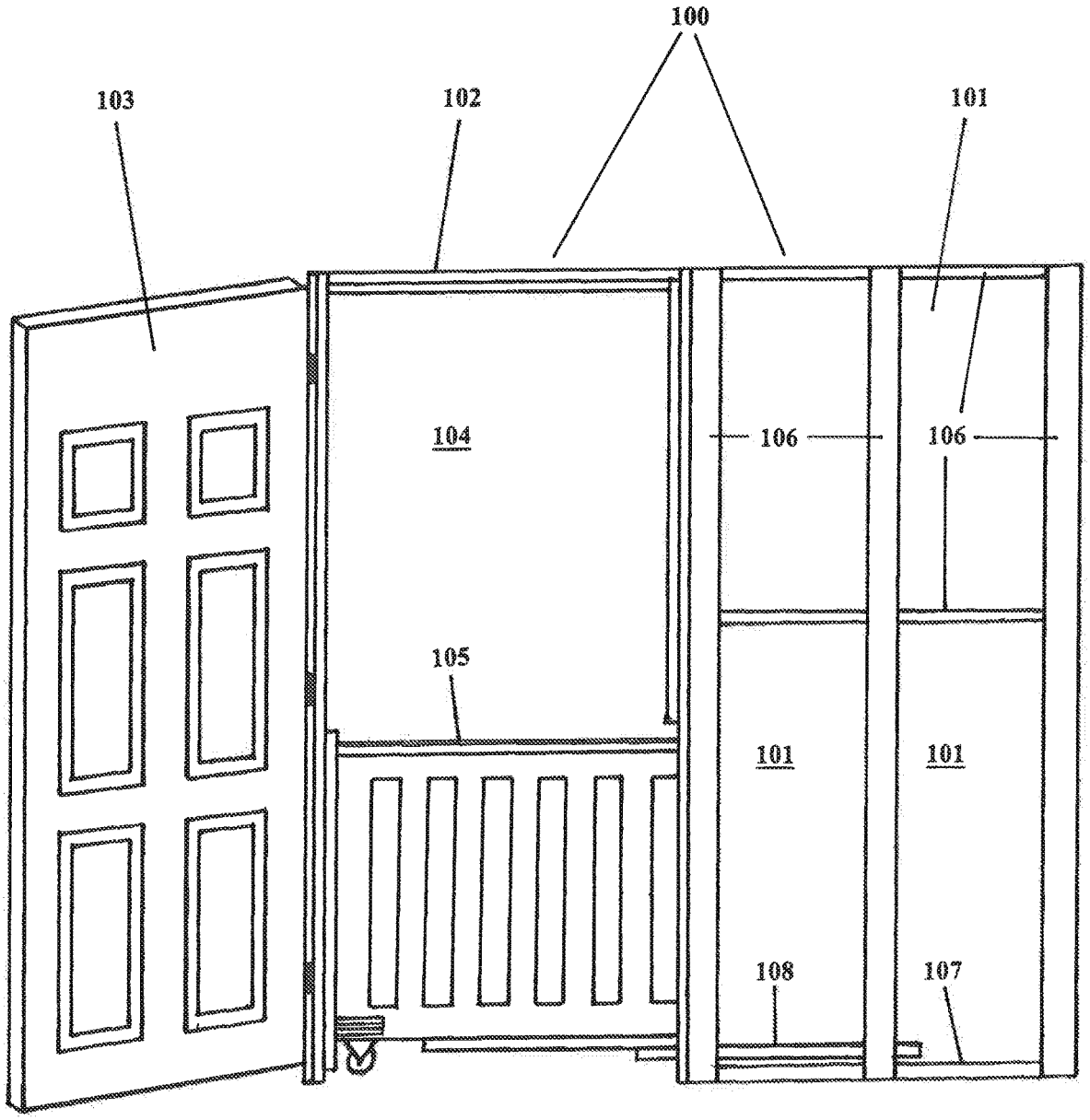
FIG. 1 shows the invention as it is—all one unit; the pre-hung hinged door, the sliding gate, and the pocket frame which houses the sliding gate—all incorporated together.

FIG. 1 illustrates the elevation view of the invention. The Interior Pre-Hung Hinged Door and Pocket Sliding Security Gate 100 represents the entire unit as one product. There are two halves to this one product. The pre-hung hinged door frame 102 and the hinged door 103 is the half that is the interior pre-hung hinged door side and the wood pocket frame 101 is the half that is the pocket frame in which the sliding security gate 105 is sliding in and out of. Putting the wood pocket frame 101 together with the pre-hung hinged door frame 102 creates the whole unit, Interior Pre-Hung Hinged Door and Pocket Sliding Security Gate 100. The hinged door 103 hinges on the pre-hung hinged door frame 102 like a standard interior pre-hung door unit but manufactured to go together with the wood pocket frame 101 which is the pocket half. This invention can be manufactured as one whole unit or two halves that fit together. Right and left hand-swinging door configurations and all standard industry sizes could be available with the corresponding sliding security gate 105 sizes. With reference to 104, this represents the pass-through opening that the hinged door 103 closes across to provide privacy and security; however, when the hinged door 103 is open and there is no need for privacy but do want the security, then the sliding security gate 105 can be pulled out of the wood pocket frame 101 opening. The pre-hung hinged door frame 102 and the hinged door 103 would typically be constructed of wood. With reference to 106, this represents a 1"×3" wood pocket framing, much like how pocket doors and their framing is constructed, but instead of the wood pocket frame 101 having a door, it is a wood pocket frame 101 with a sliding security gate 105. At the bottom where the pocket portion of the invention sits on the floor, a pressure-treated wood 1"×3" 107 serves as a bottom plate to allow for installation against all types of flooring, including concrete. With reference to 108, this represents the ball-bearing drawer sliding mechanism which helps facilitate the sliding security gates' 105 open and close, or right to left sliding action or motion.

Figure 2:
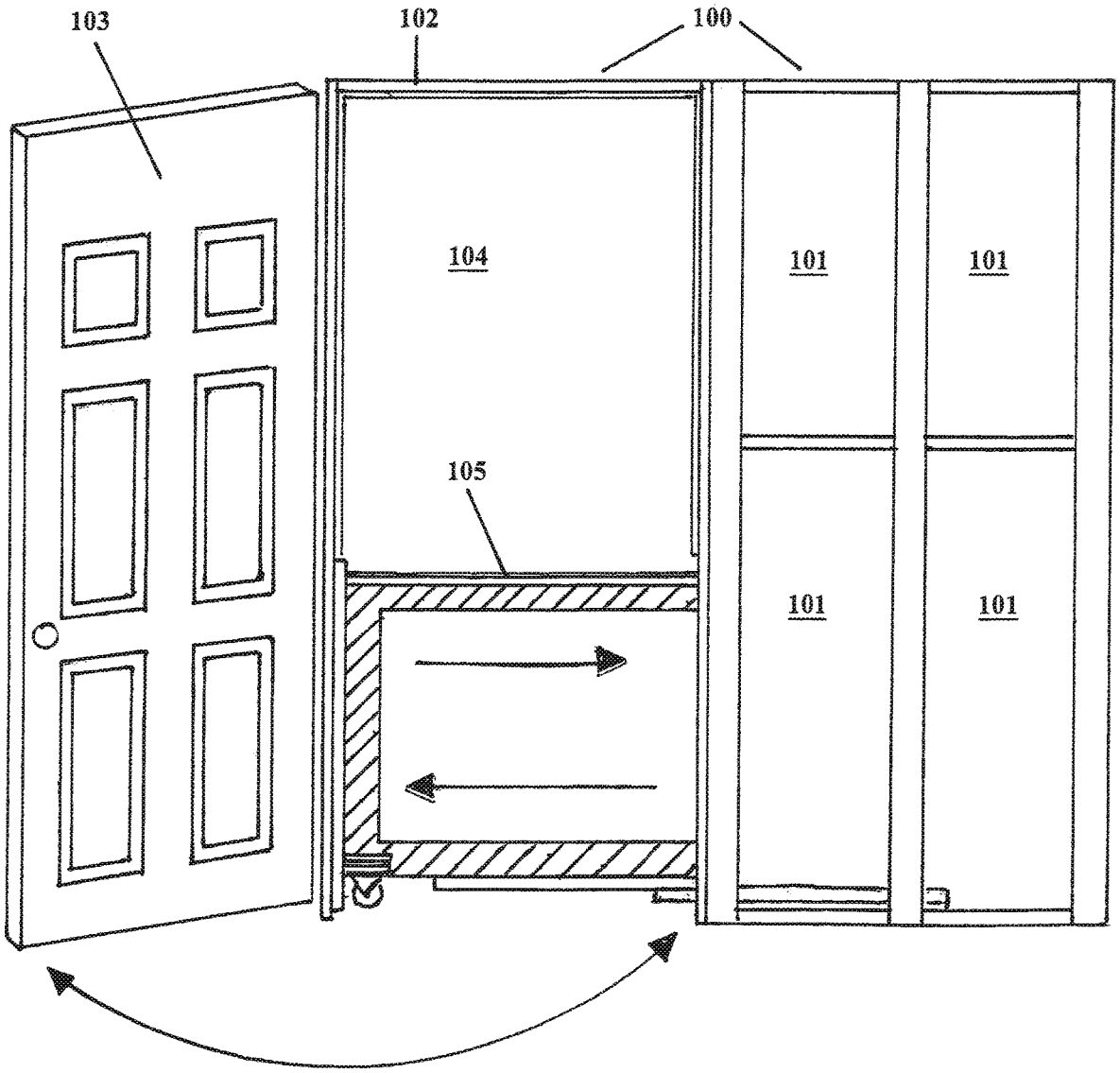
FIG. 2 shows the pre-hung hinged door in the open position and the sliding gate in the full closed position.

FIG. 2 illustrates the swinging motion of the hinged door 103 and the sliding security gates' 105 fully closed position by the directional arrows.

Figure 3:
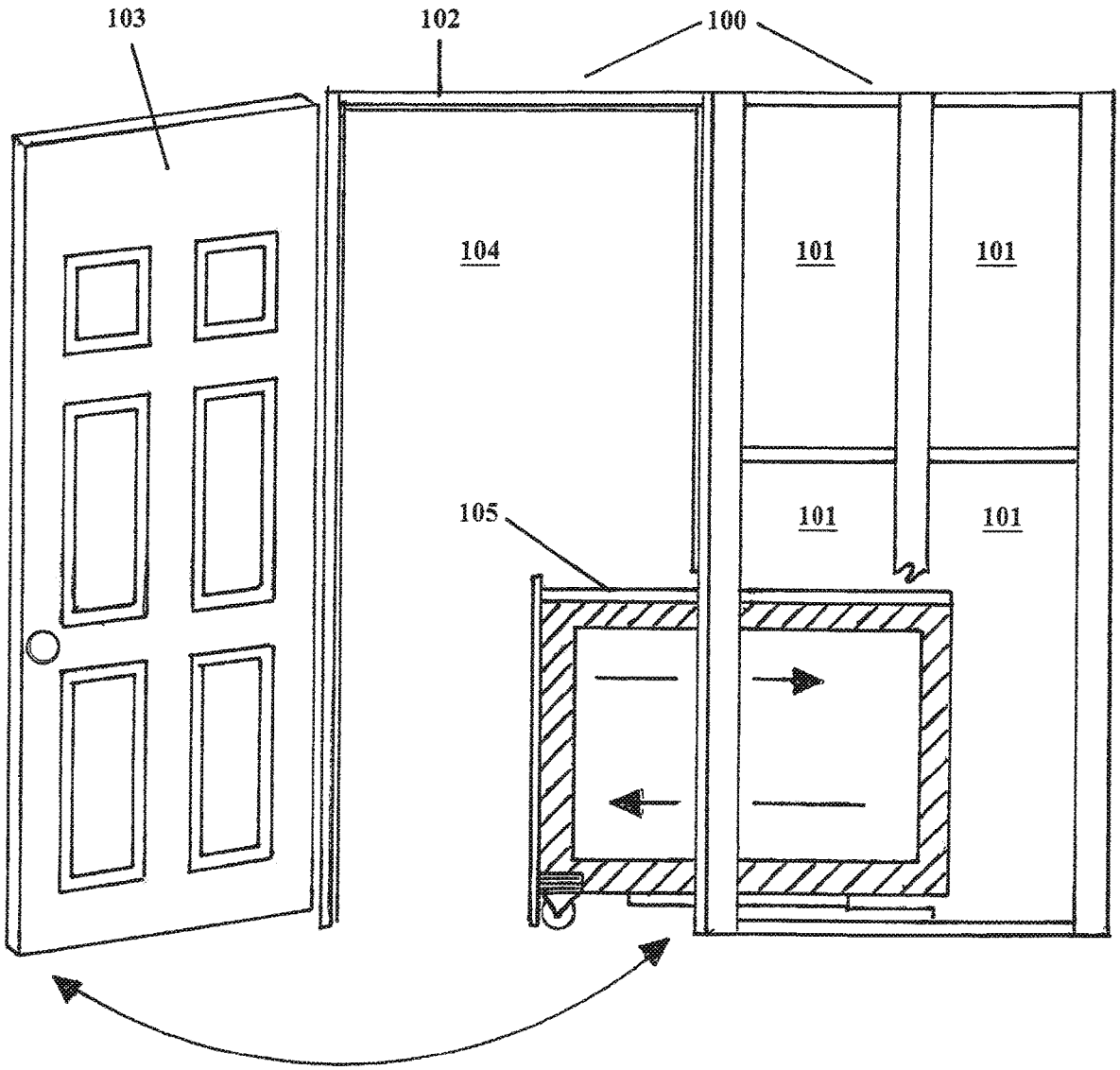
FIG. 3 shows the pre-hung hinged door in the open position and the sliding gate in the partially closed position.

FIG. 3 illustrates the sliding security gate 105 going from its closed position to its open position in the wood pocket frame 101.

Figure 4:
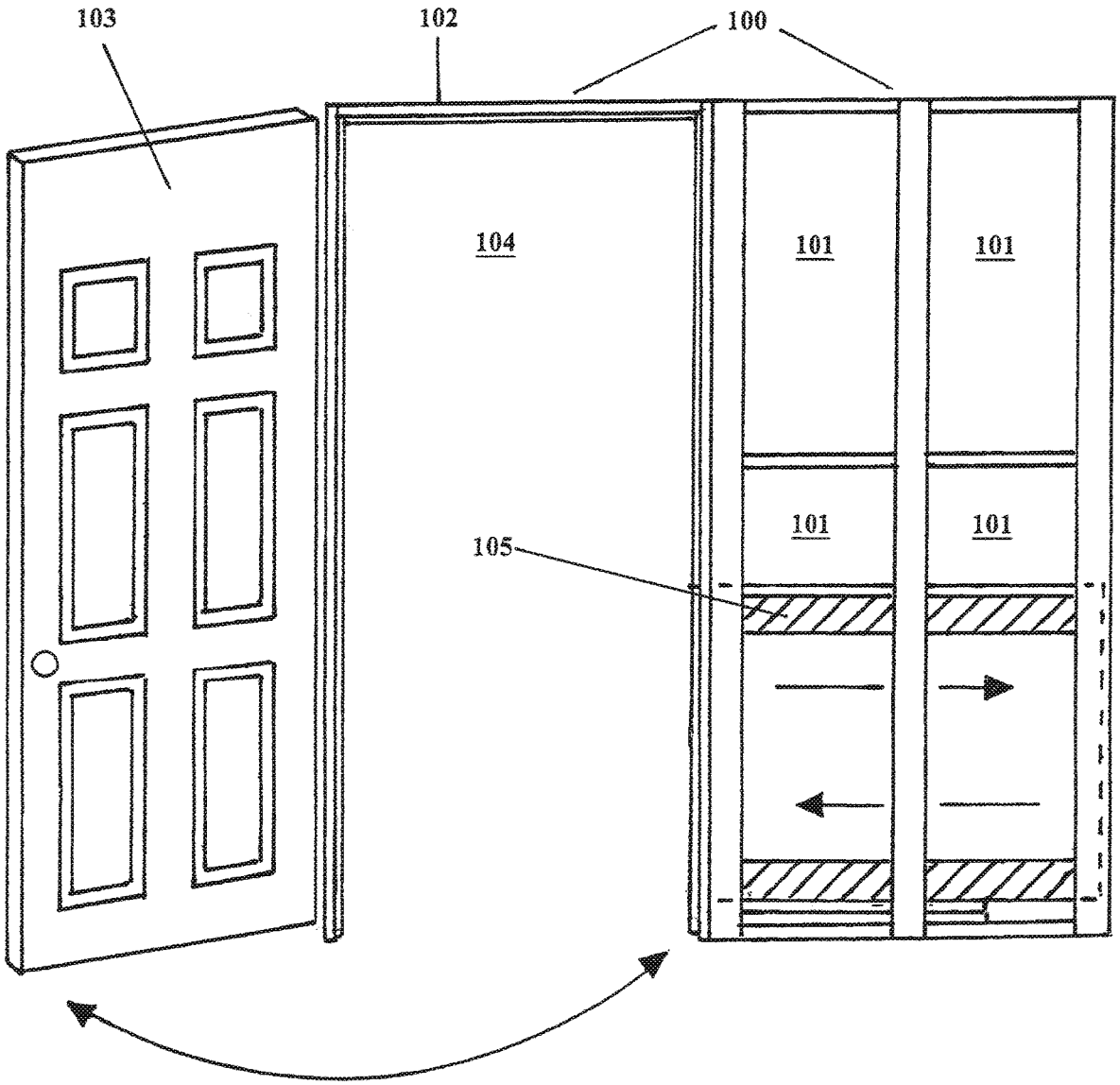
FIG. 4 shows the pre-hung hinged door in the open position and the sliding gate in the fully opened position, tucked back into the pocketed framework housing.

FIG. 4 illustrates the sliding security gate 105 in the open position in the wood pocket frame 101.

Figure 5:
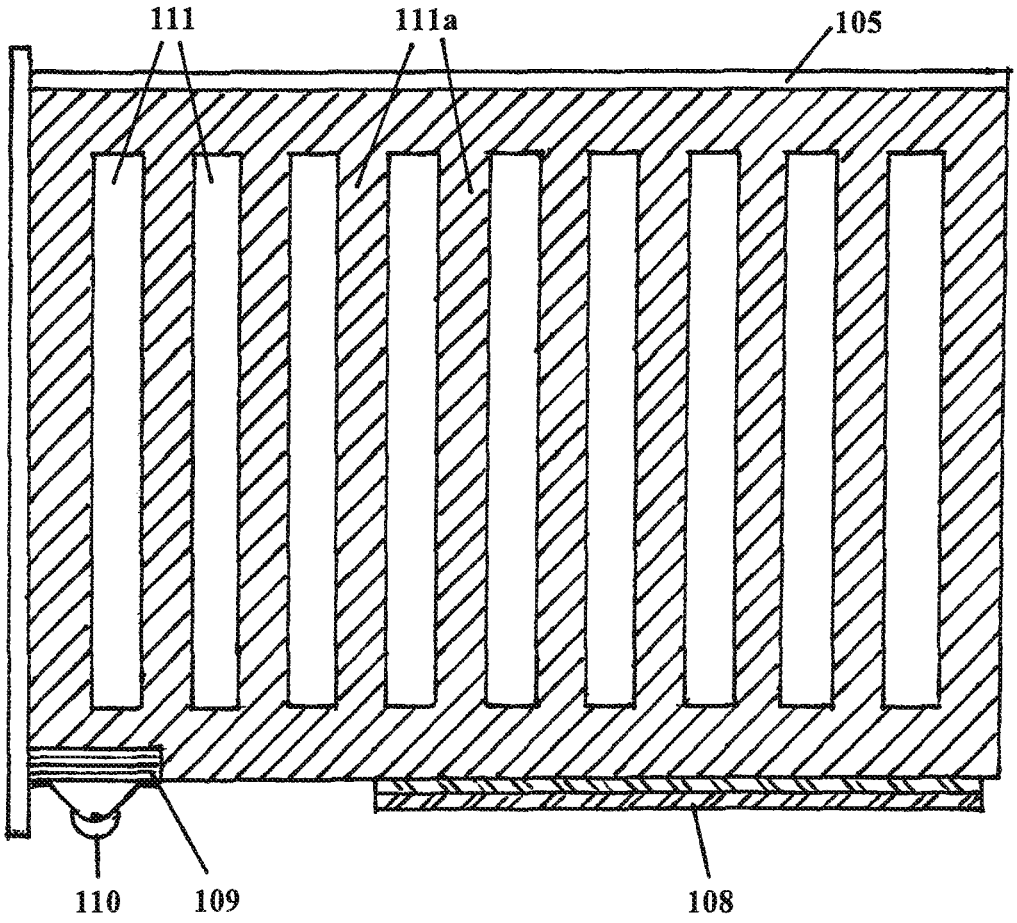
FIG. 5 shows the sliding gate alone, removed from the pre-hung hinged door and pocket frame.

FIG. 5 illustrates the sliding security gate 105 removed from the pocket to show its individual components. With reference to 111, this represents the openings between the vertical slats 111*a*. The openings 111 allows the sliding security gate 105 while in the closed position securing the opening, one can still maintain visual contact with babies and toddlers, pets, and/or the disabled elderly. With reference to 108, this represents the ball-bearing drawer slides. These sliding security gates 105 use two ball-bearing drawer slides 108; one stacked on top of another in order to allow the sliding security gate 105 to achieve the travel distance needed to fully close. With reference to 110, this represents the dolly-style wheel that carries the sliding security gates' 105 leading end when closing and opening. With reference to 109, this represents the shim-pack system devised to accommodate different thicknesses and types of flooring. The shim-pack system 109 works by adding shims between the dolly-style wheel 110 and the sliding security gate 105 when the flooring is thinner and taking the shim-pack system 109 away when the flooring is thicker.

Figures 6, 6A, 6B, 6C:
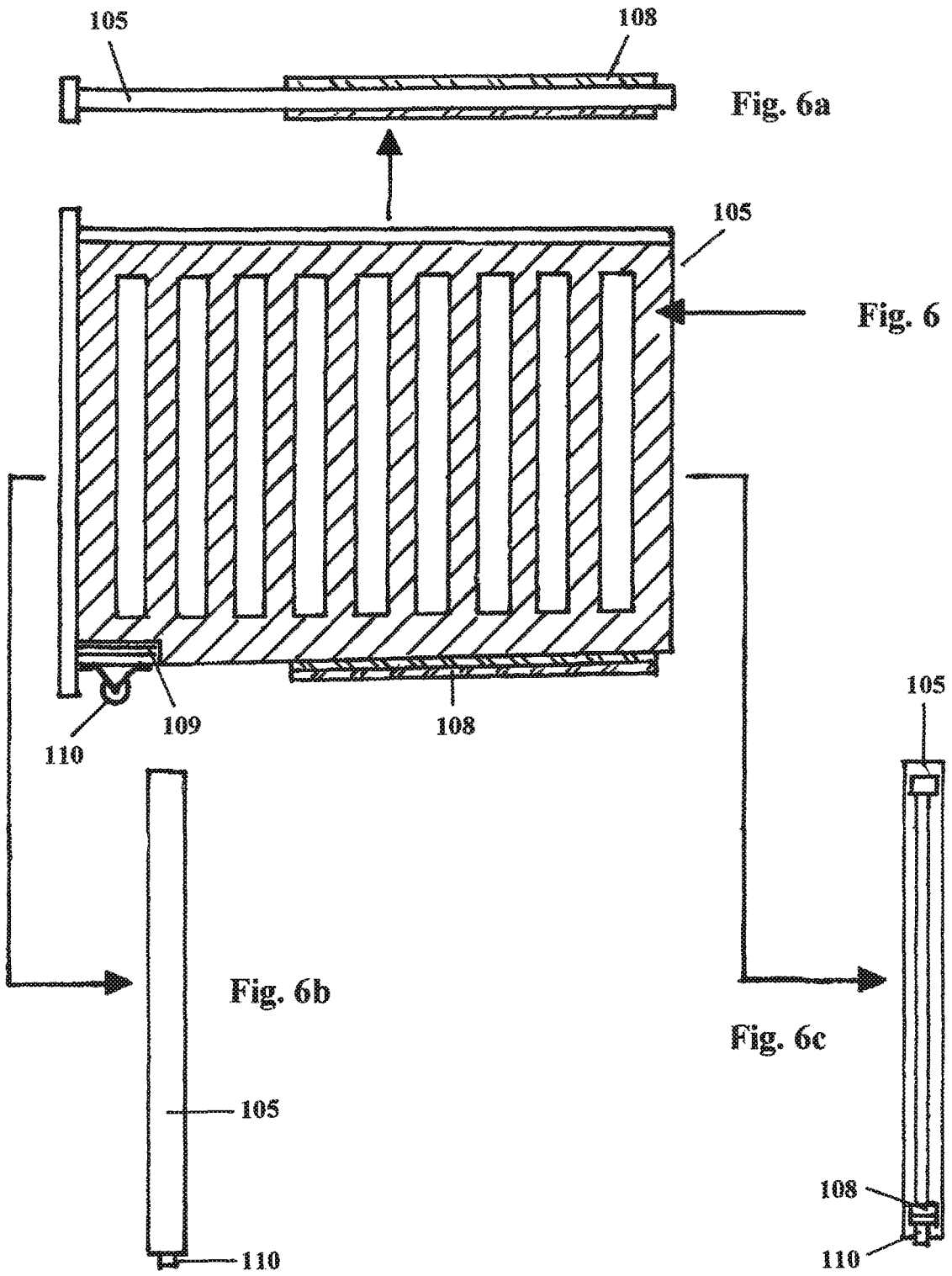
FIG. 6 shows an elevation view of the sliding gate.
FIG. 6*a* shows a cross section top view.
FIG. 6*b* shows a cross section side view.
FIG. 6*c* shows a cross section side view.

FIG. 6 illustrates the elevation view of the sliding security gate 105 portion of the invention removed from the wood pocket frame 101 as shown in FIG. 1.

FIG. 6*a* illustrates the top of the sliding security gate 105.

FIG. 6*b* illustrates the view of the sliding security gate 105 that would first slide out of the wood pocket frame 101 that it is housed in.

FIG. 6*c* illustrates the opposite end of the sliding security gate 105 from FIG. 6*b*. FIG. 6*c* is the end that first goes into the wood pocket frame 101.

Figure 7:
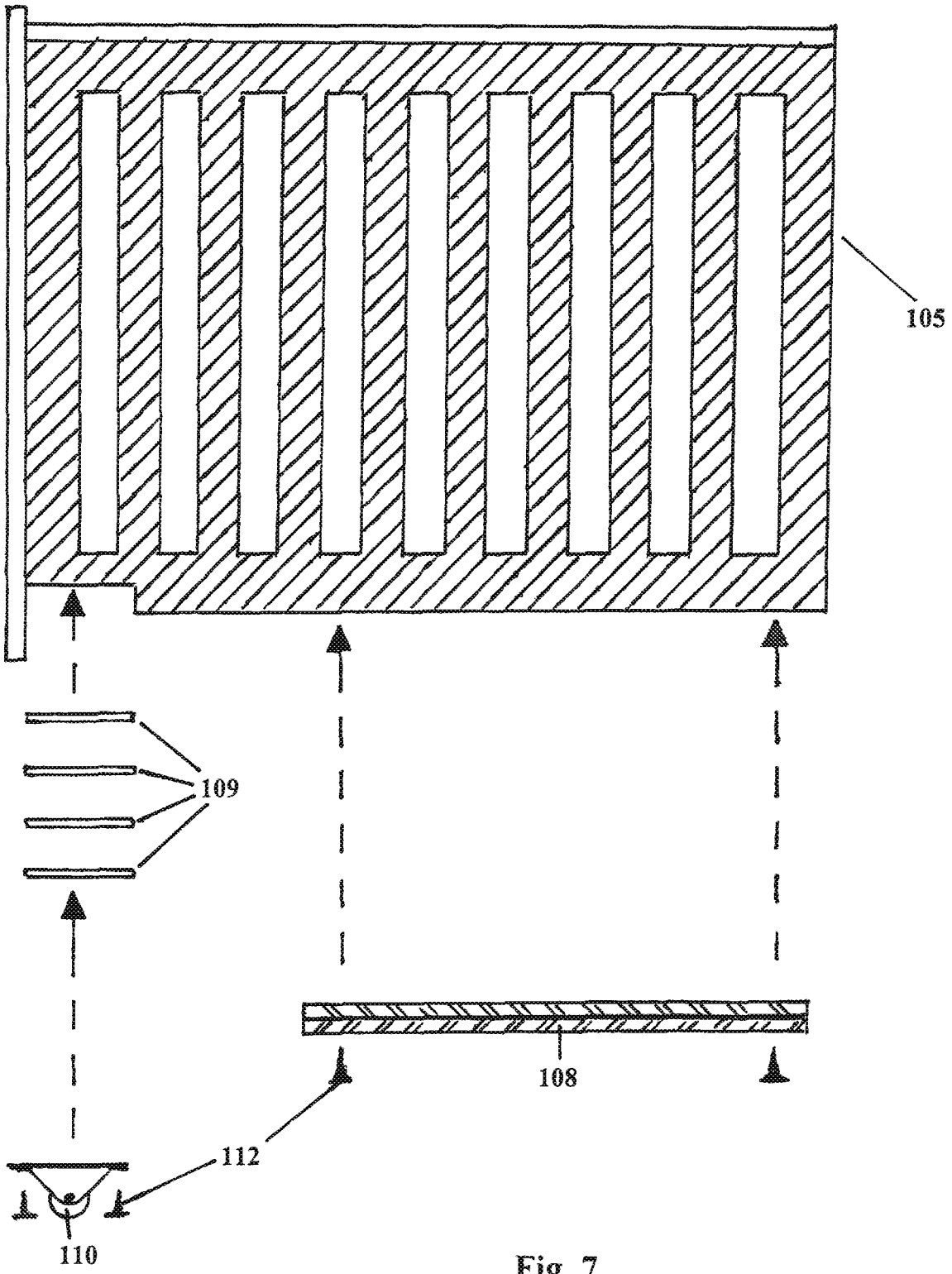
FIG. 7 shows an exploded view of the sliding gate and how its' parts fit together.

FIG. 7 illustrates an exploded view of the sliding security gate 105. The sliding security gate 105 could be constructed of many different types of materials, such as wood, metals, plastic, or composite. The sliding security gate 105 can be made in different sizes to fit with the many different pre-hung hinged door and pocket sizes needed for the many different commercial and residential applications. This invention is mainly intended to be used in new construction, as well as remodeling but also could be installed as a single project in an already-existing completed home and/or business. With reference to 108, this represents the two ball-bearing drawer slides fastened together, one on top of the other and then how it is screwed to the bottom of the sliding security gate 105 with the appropriate screw fastener 112 to secure it to whatever material the sliding security gate is made from; i.e., wood, plastic, metal, or composite. The shim pack system 109 could also be made from different types of materials. Most floors would not vary more than one inch from the rough-in surface of which the invention is installed on; therefore, the shim pack system 109 would consist of 1½" shim, 1¾" shim, and 2⅛" shims, which equals one inch. The shim pack system 109 would be installed between the bottom of the sliding security gate 105 and the dolly-style wheel 110. The dolly-style wheel 110 would be fastened to the sliding security gate 105 through the shim pack system 109 with the appropriate screw fasteners 112 to secure it.

Figure 8A:
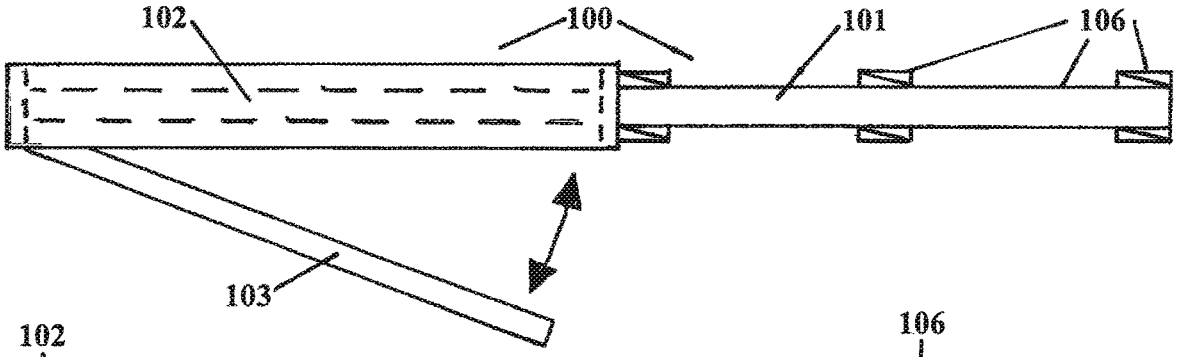
FIG. 8*a* shows a top view of the invention.

FIG. 8*a* illustrates a top view cross section of the Interior Pre-Hung Hinged Door and Pocket Sliding Security Gate 100. The hinged door 103 is attached by three hinges to the pre-hung hinged door frame 102 portion of the Interior Pre-Hung Hinged Door and Pocket Sliding Security Gate 100. The wood pocket frame 101 portion of the invention would typically be constructed by 1"×3" wood pocket framing 106 and built to size and specifications to create the wood pocket frame 101, which houses and helps facilitate the sliding security gates' 105 function, along with the proper thickness to fit into a wall so it can be covered by drywall or whatever material is covering the wall it is installed in, much in the same way a pocket door would work.

Figure 8B:
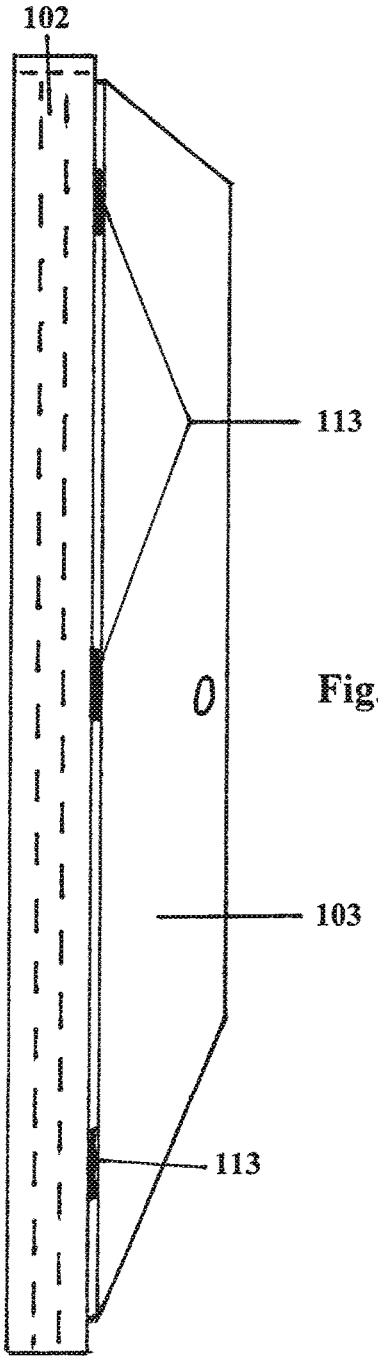
FIG. 8*b* shows a cross section view of the pre-hung hinged door end of the invention.

FIG. 8*b* illustrates a cross sectional view which shows the end of the pre-hung hinged door frame 102 that the hinged door 103 is fastened to with hinges 113. The pre-hung hinged door frame 102 is thicker than the wood pocket frame 101 because the drywall has to be flush with it so that trim can be installed.

Figure 8C:
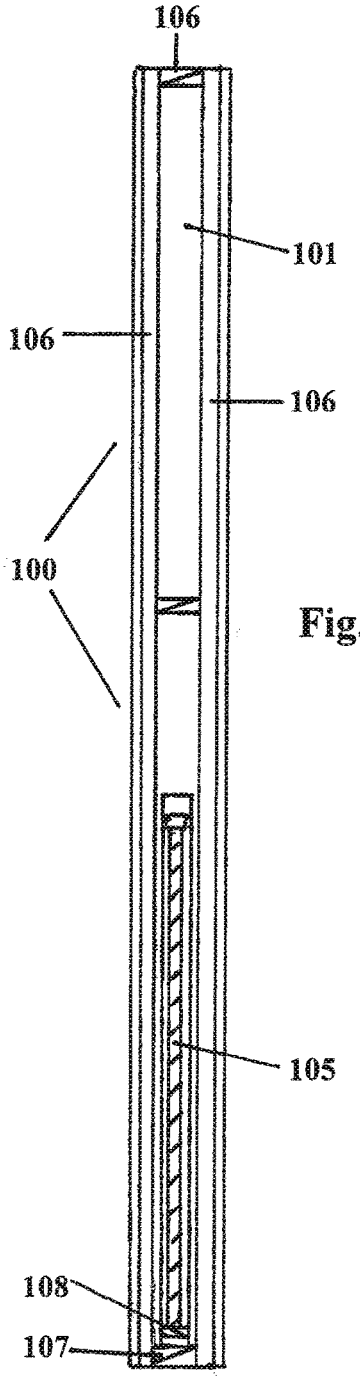
FIG. 8*c* shows a cross section view of the pocket sliding gate end of the invention.

FIG. 8*c* illustrates a cross sectional view which shows the wood pocket frame 101 end of the Interior Pre-Hung Hinged Door and Pocket Sliding Security Gate 100, which is the opposite end of FIG. 8*b*.

Figure 9:
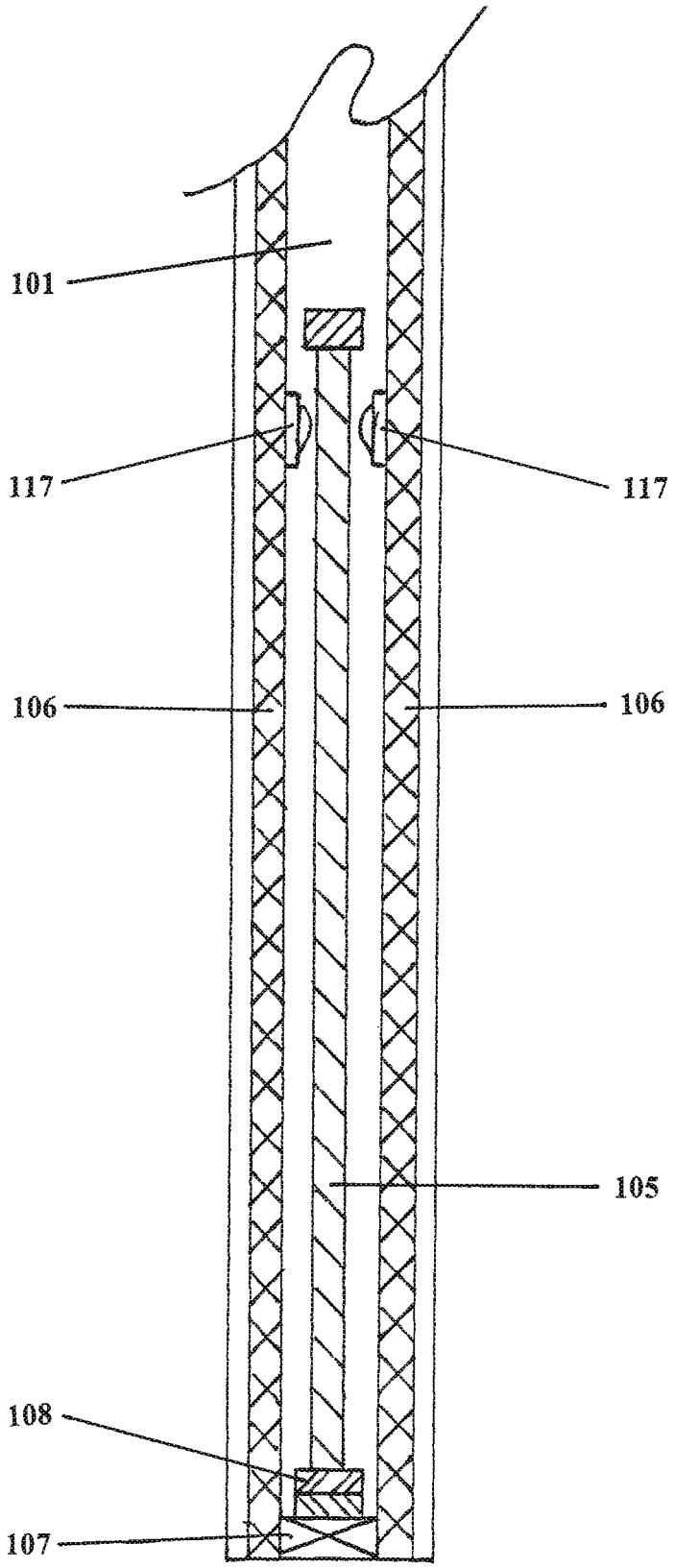
FIG. 9 shows an enlarged cross section view of FIG. 8*c*.

FIG. 9 illustrates a larger view of the bottom portion of FIG. 8*c*. This cross section is the wood pocket frame 101 end of the Interior Pre-Hung Hinged Door and Pocket Sliding Security Gate 100. The 1"×3" wood pocket framing 106 can be made to fit the wall that it is being installed in. The pressure-treated 1"×3" wood bottom plate 107 is pressure treated to allow the Interior Pre-Hung Hinged Door and Pocket Sliding Security Gate 100 to be installed on any type of floor, including concrete. The sliding security gate 105 is securely attached to the pressure-treated 1"×3' wood bottom plate 107 and is guided by two plastic or nylon glides 117; one on each side of the 1"×3" wood pocket framing 106 at the top of the wood pocket frame 101 opening where the sliding security gate 105 exits the wood pocket frame 101. The plastic or nylon glides 117 are the same plastic glides that pocket doors use where they slide out of their pocket opening.

Figure 10:
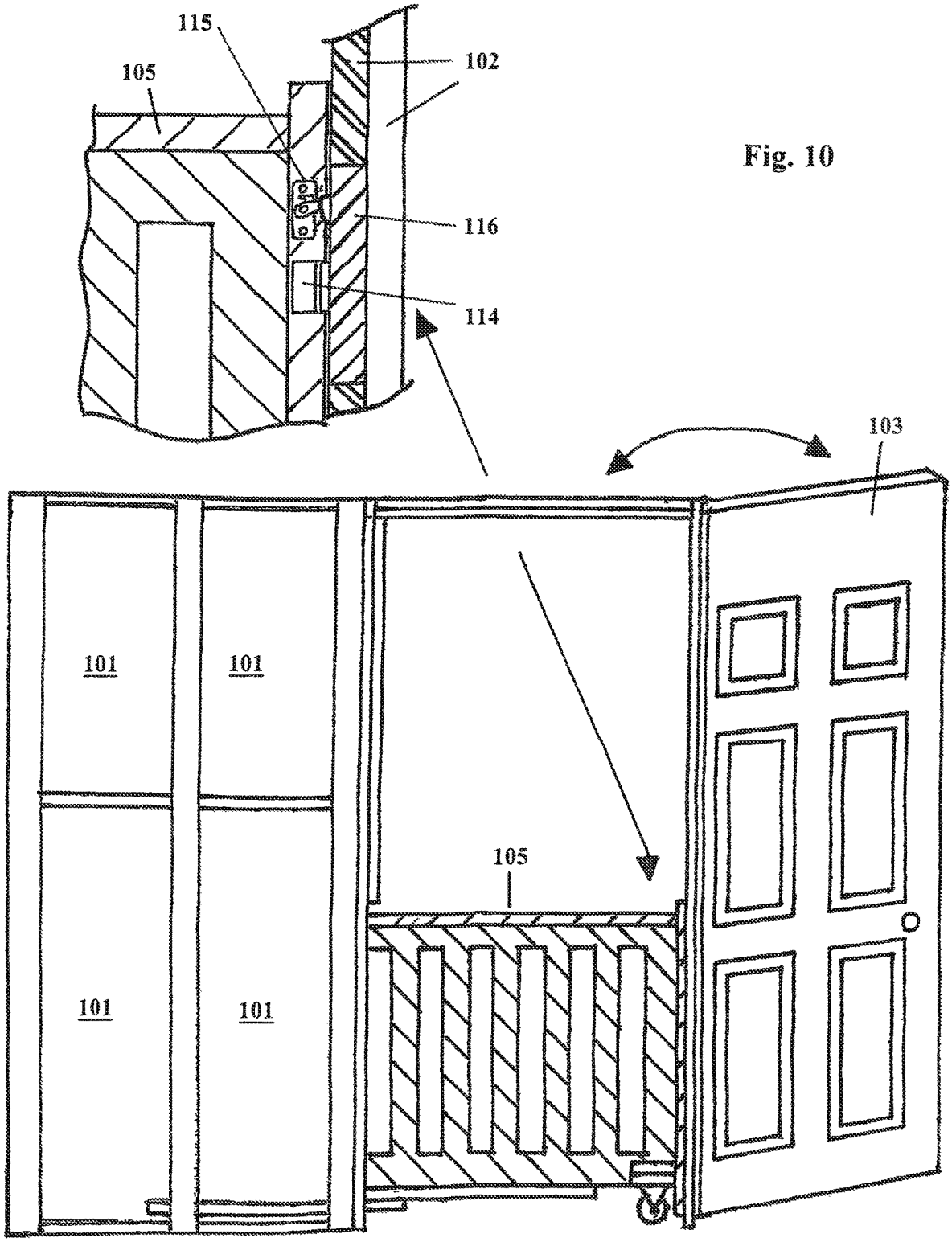
FIG. 10 shows the pocket sliding gate and how it latches to its closed position and where the battery-operated alarm mechanism is mounted.

FIG. 10 illustrates the opposite side of the Interior Pre-Hung Hinged Door and Pocket Sliding Security Gate 100 that all of the other illustrations have depicted. This view shows where the right-angle latch 115 and the battery-operated alarm 114 feature is installed on both the sliding security gate 105 and on the pre-hung hinged door frame 102. With reference to 116, this represents a door stop extension which acts as a mounting block on the pre-hung hinged door frame 102 to provide a door stop extension 116 for the receiver half of the right-angle latch 115 and the stationary half of the battery-operated alarm 114 to be attached to. The other half of right-angle latch 115 and battery-operated alarm 114 attaches to the sliding security gate 105. Sliding security gate 105 can be pulled out of its wood pocket frame 101 and closed against the adjacent pre-hung hinged door frame 102 where it can be securely latched and the battery-operated alarm 114 activated if desired. When the sliding security gate 105 is open and slid back into its wood pocket frame 101, the pass-through opening 104 allows for full access because sliding security gate 105 is completely out of the way while in the wood pocket frame 101 position. The existing safety gates today make it more difficult to pass through due to clamps, side-wall brackets, and other components that narrows the opening.

Figure 11:
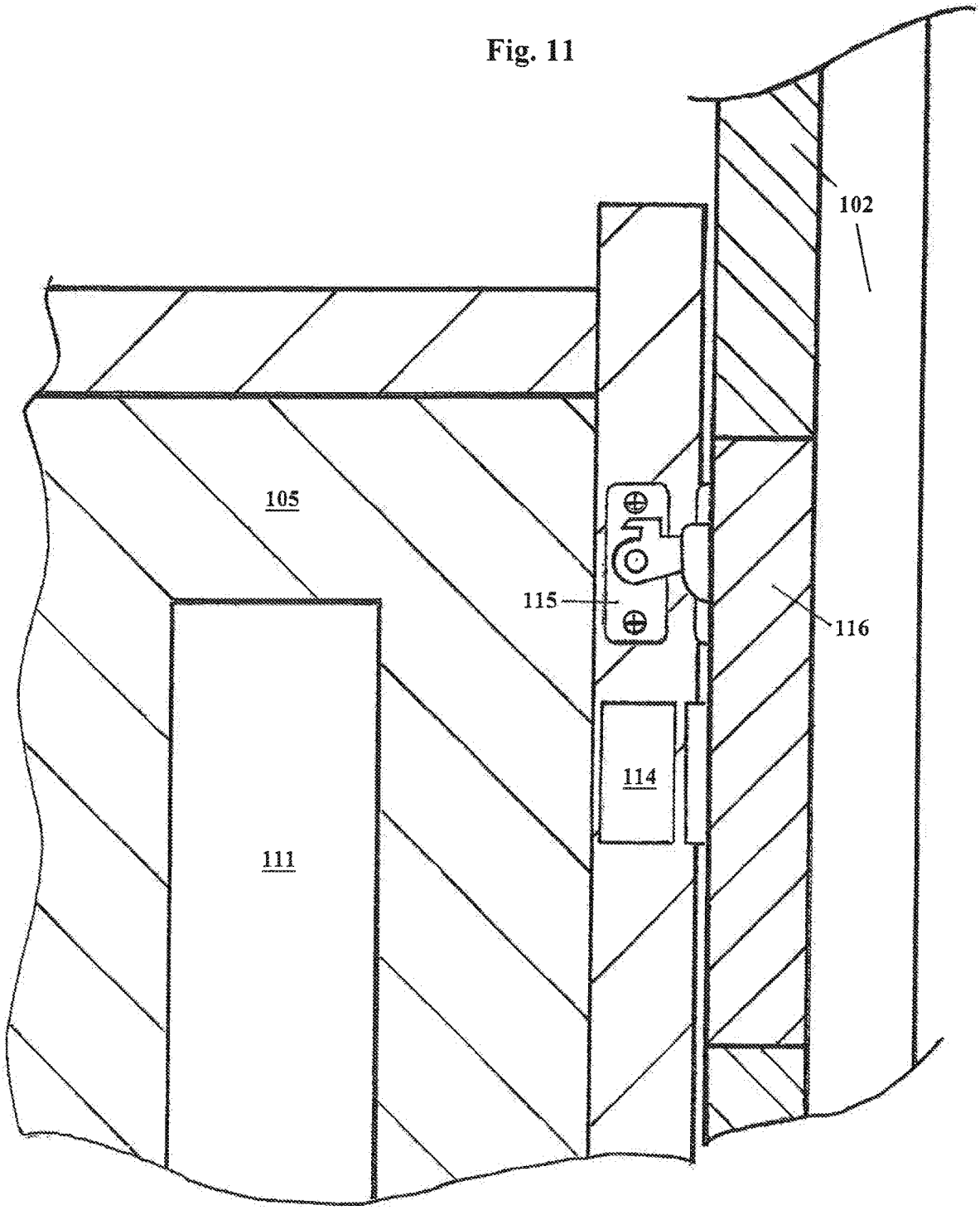
FIG. 11 shows an enlarged view of FIG. 10 and the locations of the right-angle latch, along with the battery-operated alarm mechanism.

FIG. 11 illustrates an enlarged view of FIG. 10 whereby it allows for a clearer understanding of the right-angle latch 115 and the battery-operated alarms' 114 location. The battery-operated alarm 114 has a self-adhesive back on both halves and can easily be installed. The right-angle latch 115 is attached with screws. With reference to 111, this represents the openings between the vertical slats 111*a* of the sliding security gate 105.

The disclosed embodiments have been described in full details of the structure and features of this invention, which comprises of a three-fold security gate apparatus—an interior pre-hung hinged door with a pocket which houses a security gate that can open and close across the door opening. Several examples have been described that have been referenced to various disclosed embodiments. These embodiments are for the illustration purposes and are not limited in nature. This invention should not be limited to the design of the Interior Pre-Hung Hinged Door and Pocket Sliding Security Gate and is not limited to the particular embodiments that are disclosed herein. It is however, intended to cover all modifications, changes, and adaptations within the scope of this present invention as is defined by the appended claim.

What is claimed is:

1. A sliding security gate with an interior wood door frame, a hinged door, and wood pocket frame, said sliding security gate comprising:

a top and a bottom horizontal member and a right and a left vertical member; said horizontal members fasten together with said vertical members with 90 degree connections at ends of said horizontal and said vertical members forming a rectangle-shaped frame wherein said top and said bottom horizontal members are longer than a height of said right and said left vertical members creating a perimeter frame of said sliding security gate;

the sliding security gate further comprising vertical slats equally spaced inside said perimeter frame of said sliding security gate;

the sliding security gate further comprising an opening between said vertical slats too small for a child or a pet to escape through said sliding security gate; said openings between said vertical slats allow visual contact to be maintained though said sliding security gate;

the sliding security gate further comprising a ball-bearing drawer slide mechanism, one portion of said ball-bearing drawer slide mechanism fastened on top of another portion of said ball-bearing drawer slide mechanism fastened to a bottom of said sliding security gate which allows said sliding security gate a travel distance required to open and close said sliding security gate across a pass-through opening of a doorway;

the sliding security gate further comprising a shim-pack system that includes at least two shims and adding or removing a shim or shims from said shim-pack system allows said sliding security gate to function with different thicknesses of flooring; thicker flooring requiring less shims and thinner flooring requiring more shims to keep said sliding security gate level; said shim-pack system is located on a leading end of said bottom horizontal member of said sliding security gate; said shim-pack system fits into a square notched cut-out section of said leading end of said bottom member of said sliding security gate;

the sliding security gate further comprising a dolly-style wheel fastened to said shim-pack system wherein said dolly-style wheel provides support to said leading end of said sliding security gate while being slid into a closed position; removing said dolly-style wheel provides access to said shim-pack system;

the sliding security gate further comprising the interior wood door frame wherein the hinged door is fastened to one side of said interior wood door frame;

the sliding security gate further comprising the wood pocket frame, construction of said wood pocket frame is built with a 1"×3" dimensional lumber, said wood pocket frame is fastened to a strike side of said interior wood door frame;

the sliding security gate further comprising a vertical wood stop trim board on a bottom half of said strike side of said interior wood door frame with an opening that said sliding security gate can be operated from, said vertical wood door stop trim board on said strike side of said interior wood door frame has two halves, a bottom half of said vertical wood door stop trim board is fastened to said leading end of said sliding security gate, and a top half of said vertical wood door stop trim board is fastened to a top half of said interior wood door frame; said bottom half of said vertical wood door stop trim board is fastened to said sliding security gate and not to said interior wood door frame; when said sliding security gate is in the open position and housed inside said wood pocket frame, said sliding security gate is concealed behind said bottom half of said vertical wood door stop trim board; when said shim-pack system and said ball-bearing drawer slide mechanism and said dolly-style wheel are all fastened to said sliding security gate, said sliding security gate is fastened to a wood bottom plate inside said wood packet frame and with an opening cut into said strike side of said interior wood door frame behind said vertical wood door stop trim board; said wood pocket frame is fastened to said strike side of said interior wood door frame and creates one unit; said sliding security gate can be pulled out of said wood pocket frame and closed across said pass-through opening; said sliding security gate can be secured to a hinge side of said interior wood door frame.

* * * * *